US010502221B2

(12) United States Patent
Meyer

(10) Patent No.: US 10,502,221 B2
(45) Date of Patent: Dec. 10, 2019

(54) LOAD SHARING SPRING FOR TANDEM THRUST BEARINGS OF SUBMERSIBLE PUMP ASSEMBLY

(71) Applicant: Baker Hughes Incorporated, Houston, TX (US)

(72) Inventor: Aron Meyer, Pryor, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 382 days.

(21) Appl. No.: 15/420,336

(22) Filed: Jan. 31, 2017

(65) Prior Publication Data

US 2017/0234321 A1 Aug. 17, 2017

Related U.S. Application Data

(60) Provisional application No. 62/294,061, filed on Feb. 11, 2016.

(51) Int. Cl.
*F04D 29/041* (2006.01)
*F04D 13/08* (2006.01)
(Continued)

(52) U.S. Cl.
CPC ..... *F04D 29/041* (2013.01); *E21B 43/128* (2013.01); *F04D 1/00* (2013.01);
(Continued)

(58) Field of Classification Search
CPC ..... F04D 29/041; F04D 1/00; F04D 13/086; F04D 29/043; F04D 29/049;
(Continued)

(56) References Cited

U.S. PATENT DOCUMENTS 3,485,537 A * 12/1969 Korner ..... B60T 17/083 188/106 F
3,801,215 A * 4/1974 Osborne ..... F04D 29/049 415/131

(Continued)

FOREIGN PATENT DOCUMENTS

WO 2002099284 A1 12/2002

OTHER PUBLICATIONS

International Preliminary Examination Report on Patentability dated Aug. 23, 2018 of corresponding PCT/US2017/016033.

(Continued)

*Primary Examiner* — Dominick L Plakkoottam
*Assistant Examiner* — Connor J Tremarche
(74) *Attorney, Agent, or Firm* — Bracewell LLP; James E. Bradley

(57) ABSTRACT

A submersible well pump assembly has upper and lower seal sections connected between the pump and a motor. The seal sections have drive shafts with thrust runners that engage thrust bearing bases. The upper drive shaft will undergo a limited amount of downward movement toward the lower drive shaft in response to wear of the upper thrust bearing base. A spring between ends of the drive shafts transfers a portion of the down thrust on the upper drive shaft to the lower drive shaft prior to the limited amount of downward movement of the upper drive shaft toward the lower drive shaft being reached. A rigid stop member in the coupling transfers down thrust directly from the upper drive shaft to the lower drive shaft, bypassing the spring, only after the limited amount of downward movement of the upper drive shaft toward the lower drive shaft has been reached.

17 Claims, 3 Drawing Sheets

(51) Int. Cl.

| | |
|---|---|
| ***F04D 29/043*** | (2006.01) |
| ***F04D 29/10*** | (2006.01) |
| ***F04D 29/62*** | (2006.01) |
| ***F04D 1/00*** | (2006.01) |
| ***F04D 29/049*** | (2006.01) |
| ***E21B 43/12*** | (2006.01) |

(52) U.S. Cl.
CPC ..... *F04D 13/086* (2013.01); *F04D 29/043* (2013.01); *F04D 29/049* (2013.01); *F04D 29/106* (2013.01); *F04D 29/628* (2013.01)

(58) Field of Classification Search
CPC ..... F04D 29/106; F04D 29/628; F04D 29/04; F04D 29/044; E21B 43/128
USPC ..... 417/1
See application file for complete search history.

(56) References Cited

U.S. PATENT DOCUMENTS

| | | | | |
|---|---|---|---|---|
| 4,409,504 | A | 10/1983 | Wilson et al. | |
| 4,723,725 | A * | 2/1988 | Comment | B65D 83/44 137/509 |
| 7,987,913 | B2 * | 8/2011 | Parmeter | E21B 43/128 166/107 |
| 8,021,132 | B2 | 9/2011 | Green | |
| 8,845,308 | B2 | 9/2014 | Tetzlaff | |
| 2004/0136849 | A1 | 7/2004 | Du et al. | |
| 2012/0257998 | A1 | 10/2012 | Parmeter et al. | |
| 2013/0101447 | A1 * | 4/2013 | Brown | E21B 4/006 417/410.1 |
| 2015/0354582 | A1 | 12/2015 | Tanner et al. | |

OTHER PUBLICATIONS

International Search Report and Written Opinion dated May 16, 2017 of corresponding PCT/US2017/016033.

* cited by examiner

LOAD SHARING SPRING FOR TANDEM THRUST BEARINGS OF SUBMERSIBLE PUMP ASSEMBLY

CROSS REFERENCE TO RELATED APPLICATION

This application claims priority to provisional application Ser. No. 62/294,061 filed Feb. 11, 2016.

FIELD OF THE DISCLOSURE

This disclosure relates in general to electrical submersible well pumps and in particular to a pump assembly with a load sharing arrangement for tandem thrust bearings.

BACKGROUND

Submersible electrical pump assemblies ("ESP") are commonly used to pump well fluids from hydrocarbon wells. A typical ESP includes a pump, normally centrifugal, driven by an electrical motor. At least one seal section connects between the motor and the pump to seal motor lubricant in the motor. The seal section has a drive shaft with a thrust runner that engages a thrust bearing base to transfer down thrust imposed by the pump drive shaft on the seal section drive shaft. The seal section may also have a pressure equalizer to reduce a pressure differential between the motor lubricant and well fluid on the exterior.

Some installations employ seal sections in tandem, each having a thrust bearing. Because of tolerances, it is difficult to construct the seal sections so that a desired amount of sharing of the down thrust occurs between the thrust bearings of the two seal sections. One of the thrust bearings may wear too quickly relative to the other.

SUMMARY

A submersible well pump assembly comprises a pump, a motor, and first and second seal sections between the pump and the motor. Rotatable first and second drive shafts in the first and second seal sections, respectively, extend along a longitudinal axis of the pump assembly. First and second thrust bearings are in the first and second seal sections, respectively. The first seal section is operably connected with the pump to cause the first drive shaft to receive down thrust from the pump and transfer the down thrust to the first thrust bearing. The first drive shaft undergoes a limited amount of movement toward the second drive shaft in response to wear of the first thrust bearing. An internally splined coupling connects ends of the first and second drive shafts together for rotation in unison. A spring is in the coupling between the ends of the first and second drive shafts. The limited amount of movement of the first drive shaft toward the second drive shaft further compresses the spring. A rigid stop member in the coupling between the ends of the first and second drive shafts has a length that determines the limited amount of movement of the first drive shaft toward the second drive shaft and limits the compression of the spring.

A portion of the down thrust imposed on the first drive shaft transfers through the spring to the second drive shaft prior to the limited amount of movement of the first drive shaft toward the second drive shaft being reached. Down thrust imposed on the first drive shaft transfers through the stop member to the second drive shaft after the limited amount of movement of the first drive shaft toward the second drive shaft is reached.

In one embodiment, the spring comprises a plurality of Belleville washers stacked on one another. A first spring plate has one side in abutment with the end of the first drive shaft and an opposite side in abutment with a first side of the spring. A second spring plate has one side in abutment with the end of the second drive shaft and an opposite side in abutment with a second side of the spring. The limited amount of movement of the first drive shaft toward the second drive shaft causes the first spring plate to move toward the second spring plate, further compressing the spring.

The stop member may be secured to one of the first and second spring plates and has a stop member end initially spaced from the other of the first and second spring plates prior to reaching the limited amount of movement of the first drive shaft toward the second drive shaft. The stop member end contacts the other of the first and second spring plates after the limited amount of movement of the first drive shaft toward the second drive shaft is reached. In the embodiment shown, the spring has a central opening. The stop member is located on the axis and extends through the opening.

The first thrust bearing comprises a first thrust runner that rotates with the first drive shaft and slidingly engages a first thrust bearing base upon initial operation of the pump. The second thrust bearing comprises a second thrust runner that rotates with the second drive shaft and optionally is initially spaced by clearance from a second thrust bearing base upon the initial operation of the pump and prior to reaching the limited amount of movement of the first drive shaft toward the second drive shaft. Continued operation causes the clearance to close and the second thrust runner to slidingly engage the second thrust bearing base.

The first spring plate may have a cylindrical side wall encircling the spring. The second spring plate has one side in abutment with the end of the second drive shaft and an opposite side in abutment with a second side of the spring. The second spring plate has a smaller diameter than an inner diameter of the cylindrical side wall of the first spring plate. A shoulder within the coupling is abutted by an end of the cylindrical side wall. The limited amount of movement of the first drive shaft toward the second drive shaft causes the cylindrical side wall to exert a force against the shoulder and push the coupling axially relative to the second drive shaft. Optionally, a ring encircles the cylindrical side wall and is in frictional engagement with an internal surface of the coupling.

DETAILED DESCRIPTION OF THE DISCLOSURE

Figure 1:
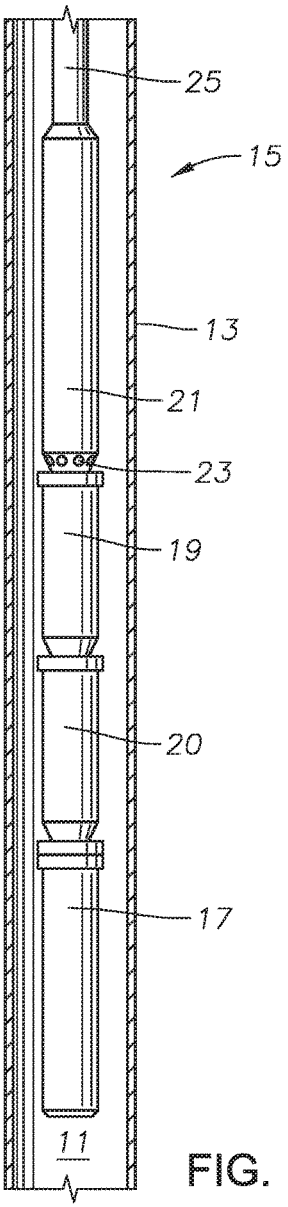
FIG. 1 is a side view of an electrical submersible well pump assembly having two seal sections in tandem, each having a thrust bearing, and a load sharing arrangement between the thrust bearings in accordance with this disclosure.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a well 11 has a string of casing 13 cemented within. An electrical submersible pump (ESP) 15 pumps well fluid flowing into casing 13. ESP 15 includes a motor 17, which is typically a three-phase electrical motor. An end of motor 17 connects to two seal sections 19, 20 that are connected to each other in tandem. Seal sections 19, 20 seal dielectric lubricant in motor 17. Also, seal sections 19, 20 may have pressure equalizing elements to equalize the pressure of the lubricant in motor 17 with the hydrostatic pressure of the well fluid on the exterior of motor 17.

A pump 21 connects to the first seal section 19. Pump 21 has an intake 23 for receiving well fluid and a discharge connected to a string of production tubing 25. Pump 21 is normally a rotary type, such as a centrifugal pump having a large number of stages, each stage having a rotating impeller and a nonrotating diffuser. Alternately, pump 21 could be another type, such as a progressing cavity pump. Although ESP 15 is shown vertically in the drawings, it could be located in inclined or horizontal sections of well 11, thus terms such as "upper" and "lower" are used only for convenience.

Figure 2:
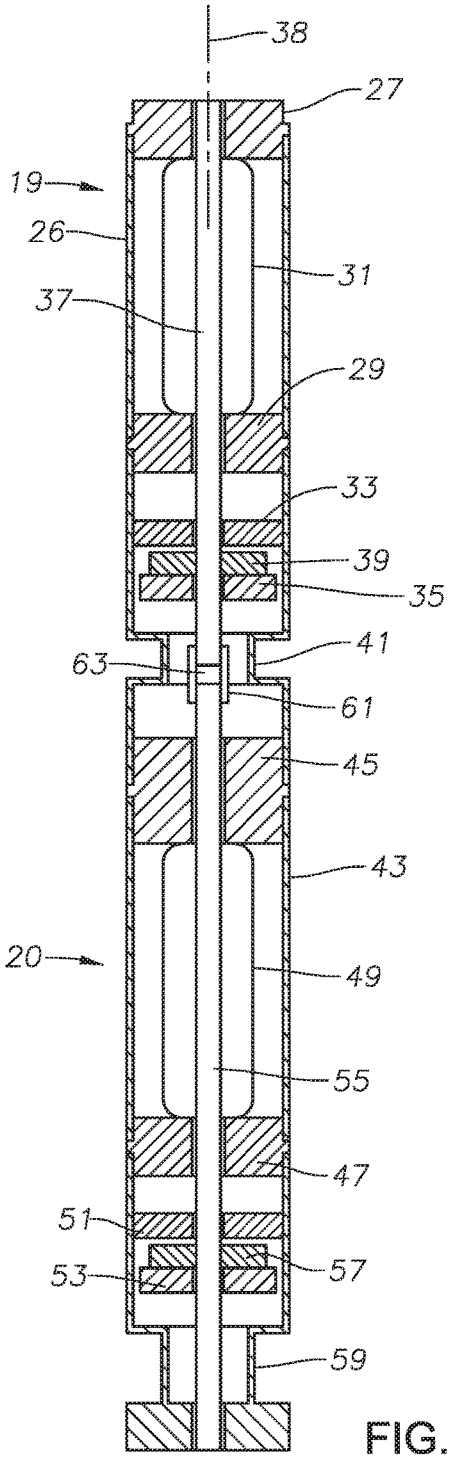
FIG. 2 is a schematic view of the two sections of FIG. 1, illustrating the load sharing arrangement of FIG. 1.

Referring to FIG. 2, first seal section 19 has a tubular housing 26 with an adapter or head 27 on one end that connects to pump 21 (FIG. 1). Housing 26 may comprise more than one tubular member, the tubular members being connected together by a central connection member or guide 29. In this embodiment, a volume or pressure equalizing element 31, located in housing 26 between head 27 and guide 29, reduces a pressure differential between lubricant in motor 17 (FIG. 1) and the hydrostatic well fluid pressure. Normally, equalizing element 31 will contain and be in fluid communication with motor lubricant in motor 17. A port (not shown) in head 27 admits well fluid to the exterior of equalizing element 31. Equalizing element 31 is illustrated to be a flexible, elastomeric bag. Alternately, it could be other types, such as a metal bellows.

First seal section 19 has a thrust bearing assembly that includes an upthrust base or bearing 33 and a down thrust base or bearing 35, each nonrotatably mounted in housing 26. A rotatable first drive shaft 37 extends though first seal section 19 along a longitudinal axis 38. A thrust runner 39, rigidly attached to drive shaft 27 for rotation and axial movement in unison, is located axially between upthrust and down thrust bearings 33, 35. Drive shaft 27 is axially movable short increments between upthrust and down thrust. A seal section base 41 secures to housing 26 at an end opposite head 27. First drive shaft 37 extends through bores and bushings in head 27, guide 29 and first seal section base 41.

While operating, pump 21 creates thrust that can vary between down thrust, which is the direction away from the discharge of pump 21, and upthrust. During down thrust, runner 39 slides on down thrust bearing 35, transferring at least some of the down thrust on first drive shaft 37 to down thrust bearing 35, which in turn transfers down thrust to housing 26. Similarly, upthrust causes runner 39 to engage and transfer upthrust to upthrust bearing 33.

Second seal section 20 may be constructed the same as first seal section 19. Second seal section 20 has a housing 43 that secures to seal base 41 of first seal section 19. Second seal section 20 has a head 45 and a connector or guide 47 axially spaced from head 45. A pressure equalizing element 49 locates between head 45 and guide 47 and operates the same as equalizing element 31 of first seal section 19. Second seal section 20 also has a thrust bearing assembly including an upthrust bearing 51 and a down thrust bearing 53. Drive shaft 55 of second seal section 20 extends through head 45, guide 47 and thrust bearings 51, 53. A runner 57 rigidly mounted to shaft 55 between thrust bearings 51, 53, engages down thrust bearing 53 during down thrust on second drive shaft 55. Runner 57 engages upthrust bearing 51 during upthrust on shaft 55. Seal section 20 has a seal base 59 that secures to motor 17 (FIG. 1).

Drive shafts 37, 55 have external splines around their ends. A sleeve or coupling 61 with internal splines joins the external splines of drive shafts 37, 55 together for rotation in unison. Motor 17 has a drive shaft (not shown) that couples to drive shaft 55 and rotates drive shafts 37, 55. Drive shaft 37 couples to a drive shaft (not shown) in pump 21 (FIG. 1) to drive pump 21. The lower end of the pump drive shaft abuts the upper end of drive shaft 37.

The down thrust bearings 35, 53 in seal sections 19, 20 are configured to share the load of down thrust imposed by pump 21 on drive shaft 37. A spring insert 63 located between the adjacent ends of drive shafts 37, 55 serves to share the load to avoid uneven wear on one of the down thrust bearings 35, 53 relative to the other.

Figure 3:
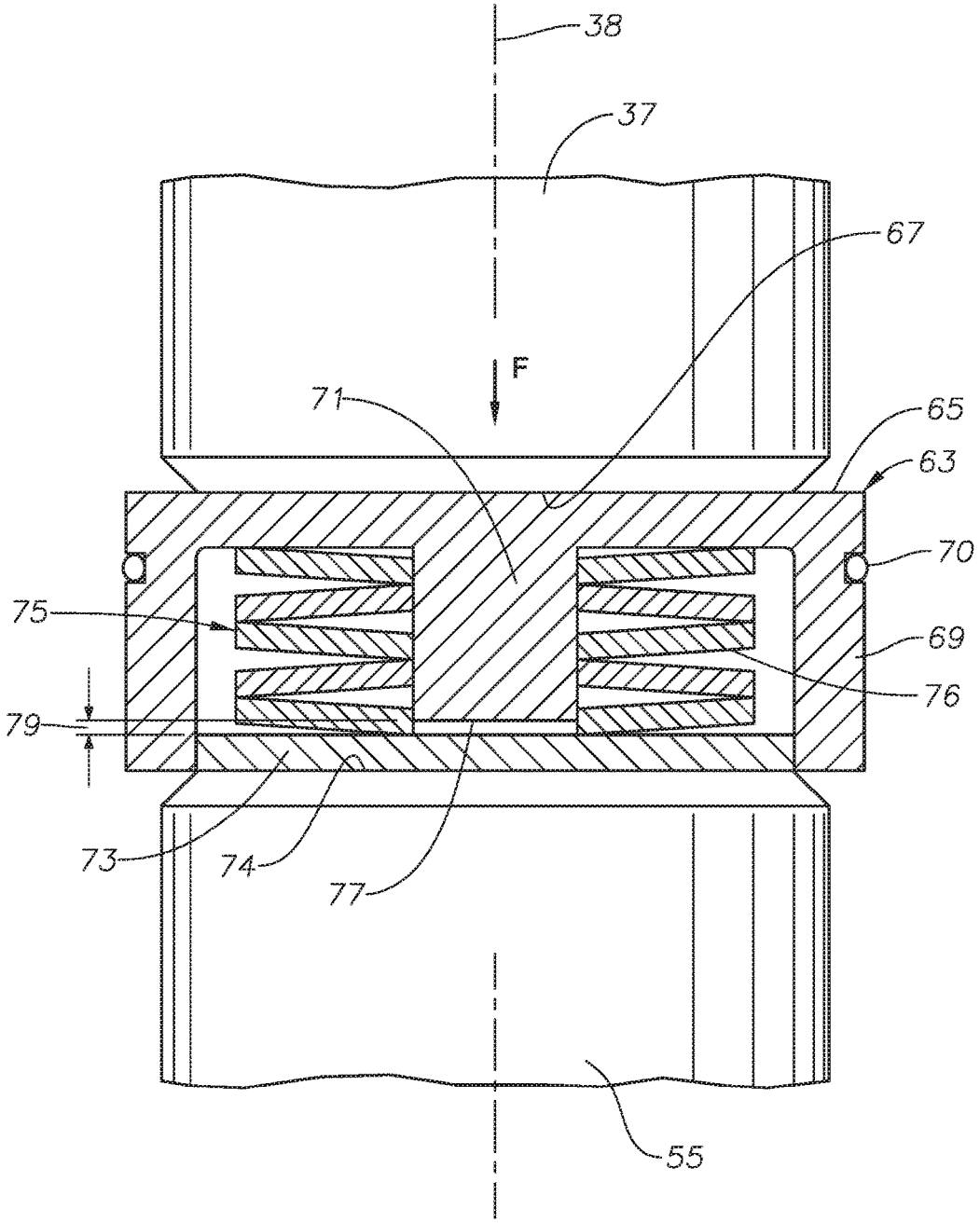
FIG. 3 is an enlarged sectional view of a load sharing insert of the load sharing arrangement of FIG. 2.

FIG. 3 shows one example of spring insert 63, and a variety of configurations are feasible. In this embodiment, spring insert 63 has a first spring plate 65 that has one side in abutment with a shaft end 67 of first drive shaft 37. Spring plate 65 may have a cylindrical side wall 69 extending toward second drive shaft 55. Side wall 69 may have an annular external seal ring 70. A stop member 71, which in this example is a post or pedestal on axis 38, depends from first spring plate 65. The axial height or dimension of stop member 71 is less than the axial dimension of side wall 69.

Spring insert 63 has a second spring plate 73 having one side facing first spring plate 65. An opposite side is in abutment with an end 74 of second drive shaft 55. In this example, second spring plate 73 has a circular circumference that fits within but doesn't contact the inner diameter of side wall 69 of first spring plate 65. Second spring plate 73 and first spring plate 65 are movable toward and away from each other, and a spring 75 urges them apart.

In this embodiment, spring 75 comprises a plurality of Belleville washers 76 stacked on each other. Each washer 76 is a steel, conical or dish-shaped member, with a convex side and a concave side. In this example, the convex sides of adjacent washers 76 in the stack are opposed to each other, and the concave sides of adjacent washers 76 are opposed to each other. Alternately, washers 76 could be stacked in other manners, such as with all of the concave sides facing in the same direction and the all of the convex sides facing in the opposite directions. The stacking of washers 76 can be altered, if desired, to achieve a nonlinear load versus displacement curve.

The overall axial height of spring 75, while not being compressed, is greater than the axial dimension of stop member 71. During operation, shaft end 67 can move axially toward shaft end 74 a limited amount. When shaft ends 67, 74 are at a maximum distance apart, which occurs prior to initial operation, a gap 79 between an end 77 of stop member 71 and second spring plate 73 exists. Spring 75 may be under some compression and exert a bias force between shaft ends 67 and 74 when first and second seal sections 19, 20 are first connected to each other and a maximum gap 79 exists. When shaft ends 67, 74 are a minimum distance apart from each other, gap 79 closes and stop member end 77 bears against second spring plate 73. With gap 79 closed, spring 75 will be exerting a maximum bias force.

Second runner 57 and second down thrust bearing 53 optionally may be configured such that second runner 57 does not touch second thrust bearing 53 while gap 79 is fully open. An initial clearance between second thrust runner 57 and second down thrust bearing 53 could exist. Alternately, some contact of second runner 57 with second down thrust bearing 53 could occur while gap 79 is fully open.

If first down thrust bearing 35 absorbs all of the down thrust imposed by pump 21 on first drive shaft 37, gap 79 will be at a maximum. In that instance, all of the down thrust on first drive shaft 37 would transfer from first runner 39 to first down thrust bearing 35. As first down thrust bearing 35 wears, first drive shaft 37 moves slightly downward, further compressing spring 75 and transferring a portion of the down thrust through spring 75 to second drive shaft 55. The load experienced by first down thrust bearing 35 decreases because part of the down thrust will be transferred from second runner 57 to second down thrust bearing 53. When stop member end 77 abuts second plate 73, almost all or all of the down thrust would be taken by second down thrust bearing 53. At this point the down thrust on first drive shaft 37 transfers directly to second drive shaft 55 through stop member 71, bypassing any down thrust through spring 75.

Optionally, the clearances in the down thrust bearings 35, 53 in first and second seal sections 19, 20 and the dimensions of spring insert 63 may be selected such that gap 79 is removed once first thrust bearing 35 begins to wear. In that instance, second down thrust bearing 53 would begin to share the load and reduce the load on first down thrust bearing 35 until stop member end 77 abuts second plate 73. At that point nearly all of the down thrust on first drive shaft 37 would be absorbed by second thrust bearing base 57.

Figure 4:
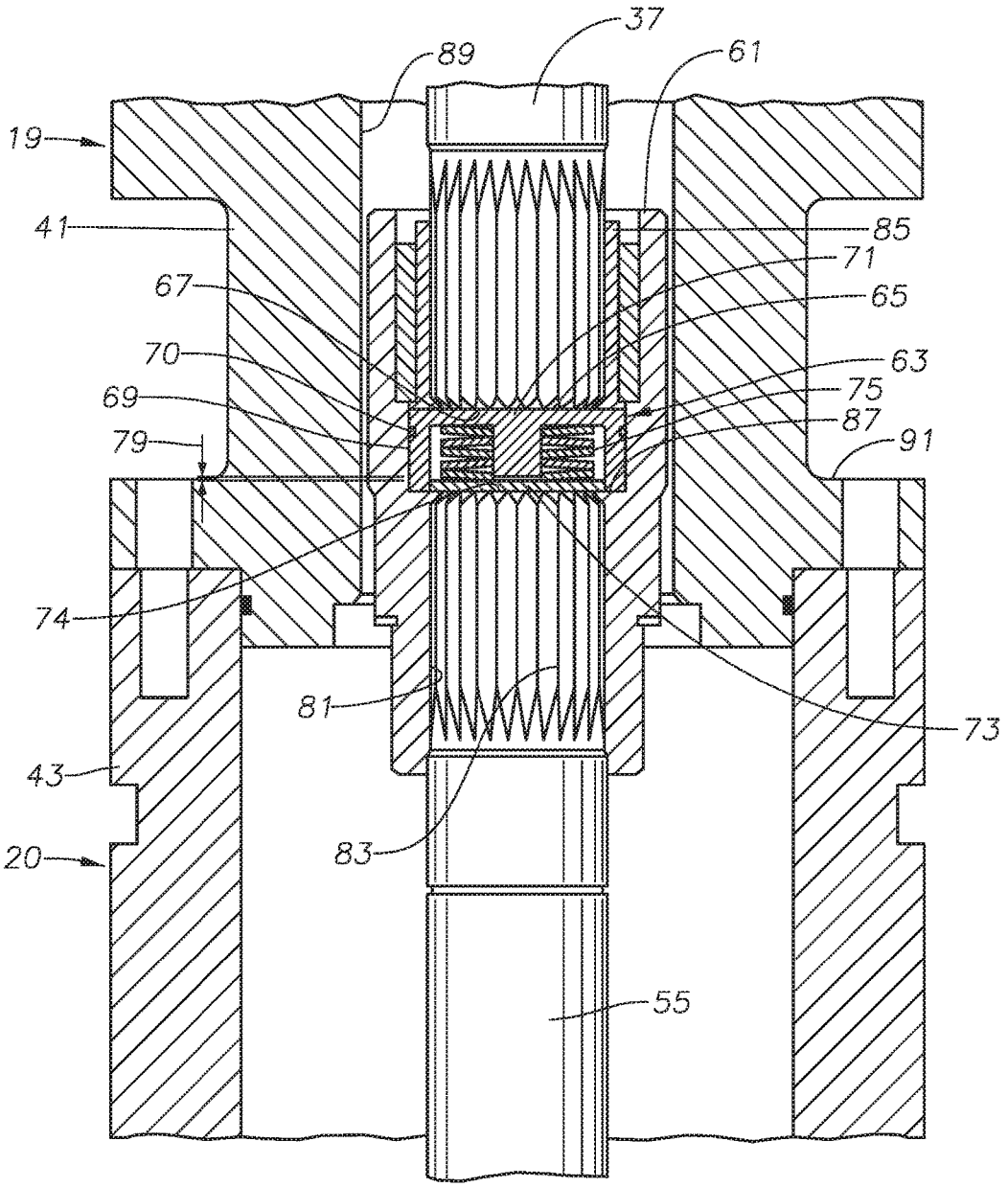
FIG. 4 is a sectional view of a connection between the two seal sections of FIG. 1 and showing the load sharing arrangement between the thrust bearings.

FIG. 4 shows more details of coupling 61 and first seal section base 41. Coupling 61 has internal splines 81 for receiving external splines 83 of both drive shafts 37, 55. Internal splines 81 in a first half of coupling 61 optionally may be located in a sleeve 85 carried in and forming a first part of coupling 61. Coupling 61 has an internal shoulder 87 that faces first shaft end 67. First spring plate side wall 69 engages shoulder 87, preventing any movement of first spring plate 65 toward shoulder 87. Seal ring 70 frictionally engages a portion of the inner side wall of the side wall of the bore in coupling 61 to retain spring insert 63 in coupling 61 prior to connecting first and second seal sections 19, 20. Seal ring 70 is optional and does not perform a sealing function as there would normally be no fluid pressure difference across seal ring 70. Second spring plate 73 is free to move axially relative to shoulder 87.

First seal section base 41 has an axial passage within which coupling 61 locates. Coupling 61 rotates in unison with first and second shafts 37, 55. In this example, an external flange 91 on first seal section base 41 abuts an end of second seal section housing 43. Bolts (not shown) secure flange 91 to housing 43. Alternately, a rotatable threaded sleeve could be used to connect seal sections 19 and 20.

Initially and prior to operation, gap 79 exists. During operation, as first thrust base 35 (FIG. 2) wears, slight downward movement of first drive shaft 37 pushes downward on first spring plate 65. First spring plate side wall 69 pushes downward on spring 75, which further compresses spring 75 and increases a downward force through spring 75 and second spring plate 73 against the upper end of second drive shaft 55. This downward force passing through spring 75 transfers through second thrust runner 57 to second thrust bearing base 53 (FIG. 2).

The slight downward movement of first spring plate side wall 69 causes coupling 61 to move downward along with the downward movement of first shaft 37. The downward movement of coupling 61 relative to second shaft 55 does not impose any down thrust on second shaft 55. Gap 79 decreases and closes up as first thrust bearing 35 wears in response to the slight downward movement of first shaft 37 relative to second shaft 55, transferring down thrust directly from first shaft end 67 through stop member 71 to second shaft end 74.

The present invention described herein, therefore, is well adapted to carry out the objects and attain the ends and advantages mentioned, as well as others inherent therein. While only a few embodiments of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A submersible well pump assembly, comprising:

a pump, a motor, and first and second seal sections between the pump and the motor;

rotatable first and second drive shafts in the first and second seal sections, respectively, each extending along a longitudinal axis of the pump assembly;

first and second thrust bearings in the first and second seal sections, respectively;

the first seal section being operably connected with the pump to cause the first drive shaft to receive down thrust from the pump and transfer the down thrust to the first thrust bearing, the first drive shaft undergoing movement toward the second drive shaft in response to wear of the first thrust bearing;

an internally splined coupling that connects ends of the first and second drive shafts together for rotation in unison;

a spring in the coupling between the ends of the first and second drive shafts, the movement of the first drive shaft toward the second drive shaft compressing the spring and transferring a portion of down thrust imposed on the first drive shaft through the spring to the second drive shaft; and a rigid stop member extending from the end of one of the drive shafts toward the end of the other of the drive shafts, the rigid stop member having a length that stops the movement of the first drive shaft toward the second drive shaft and transfers down thrust from the first drive shaft through the rigid stop member directly to the second drive shaft, bypassing the spring after the movement of the first drive shaft toward the second drive shaft has been stopped by the rigid stop member.

2. The assembly according to claim 1, wherein the spring comprises a plurality of Belleville washers stacked on one another.

3. The assembly according to claim 1, further comprising:

a first spring plate having one side in abutment with the end of the first drive shaft and an opposite side in abutment with a first side of the spring;

a second spring plate having one side in abutment with the end of the second drive shaft and an opposite side in abutment with a second side of the spring; and wherein the rigid stop member extends from one of the first and second spring plates and contacts the other of the first and second spring plates to stop the movement of the first drive shaft toward the second drive shaft.

4. The assembly according to claim 1, wherein:

the spring has a central opening; and the rigid stop member is located on the longitudinal axis and extends through the central opening.

5. The assembly according to claim 1, wherein:

the first thrust bearing comprises a first thrust runner that rotates with the first drive shaft and slidingly engages a first thrust bearing base upon initial operation of the pump;

the second thrust bearing comprises a second thrust runner that rotates with the second drive shaft and is spaced by clearance from a second thrust bearing base upon the initial operation of the pump and prior to the rigid stop member stopping the movement of the first drive shaft toward the second drive shaft; and continued operation after the rigid stop member has stopped the movement of the first drive shaft toward the second drive shaft causes the clearance to close and the second thrust runner to slidingly engage the second thrust bearing base.

6. The assembly according to claim 1, further comprising:

a first spring plate having one side in abutment with the end of the first drive shaft and an opposite side in abutment with a first side of the spring, the first spring plate having a cylindrical side wall encircling the spring;

a second spring plate having one side in abutment with the end of the second drive shaft and an opposite side in abutment with a second side of the spring, the second spring plate having a smaller diameter than an inner diameter of the cylindrical side wall of the first spring plate;

a shoulder within the coupling that is abutted by an end of the cylindrical side wall; and wherein the movement of the first drive shaft toward the second drive shaft causes the cylindrical side wall to exert a force against the shoulder and push the coupling relative to the second drive shaft.

7. The assembly according to claim 1, further comprising:

a spring plate located between the end of one of the first and second drive shafts and the spring, the spring plate having a cylindrical side wall encircling the spring; and a ring encircling the cylindrical side wall and in frictional engagement with an internal surface of the coupling.

8. A submersible well pump assembly, comprising:

a pump operably driven by a motor;

upper and lower seal sections connected between the pump and the motor;

upper and lower drive shafts in the upper and lower seal sections, respectively, each extending along a longitudinal axis of the assembly;

an-upper and lower thrust runners fixed to the upper and lower drive shafts, respectively for rotation therewith;

upper and lower thrust bearing bases in the upper and lower seal sections, respectively, for rotating engagement by the upper and lower thrust runners, respectively;

the upper drive shaft configured to undergo an amount of downward movement toward the lower drive shaft in response to wear of the upper thrust bearing base caused by down thrust on the upper drive shaft;

an internally splined coupling that connects ends of the upper and lower drive shafts together for rotation in unison;

a spring within the coupling between ends of the upper and lower drive shafts, the spring being configured such that a portion of the down thrust on the upper drive shaft passes through the spring to the lower drive shaft during the amount of downward movement of the upper drive shaft toward the lower drive shaft; and upper and lower spring plates in the coupling that sandwich the spring between them and are in abutment with the ends of the upper and lower drive shafts, one of the spring plates comprising a rigid stop member having an axial length that is selected to contact the other of the spring plates and stop the amount of downward movement of the upper drive shaft toward the lower drive shaft, and to transfer down thrust from the upper drive shaft to the lower drive shaft directly through the rigid stop member, bypassing the spring, only after the amount of downward movement of the upper drive shaft toward the lower drive shaft has been reached.

9. The assembly according to claim 8, further comprising:

a cylindrical side wall encircling the spring and depending from the upper spring plate;

a shoulder within the coupling that is abutted by a lower end of the cylindrical side wall prior to contact of the rigid stop member with said other of the spring plates, wherein the amount of downward movement of the upper drive shaft toward the lower drive shaft causes the cylindrical side wall to exert a force against the shoulder and push the coupling downward relative to the second drive shaft; and the rigid stop member comprises a pedestal secured to said one of the spring plates and extending through a central opening in the spring toward said other of the spring plates.

10. The assembly according to claim 8, wherein the spring comprises a plurality of Belleville washers stacked on one another.

11. The assembly according to claim 8, wherein:

the spring comprises a stack of Belleville washers; and the rigid stop member comprises a pedestal affixed to said one of the spring plates and extending through an opening in the washers toward the other of the spring plates.

12. The assembly according to claim 8, wherein:

the lower thrust runner is spaced by clearance from the lower thrust bearing base upon the initial operation of the pump and prior to the rigid stop member stopping the amount of downward movement of the upper drive shaft toward the lower drive shaft; and continued operation after the rigid stop member has stopped the amount of downward movement of the upper drive shaft toward the lower drive shaft causes the clearance to close and the lower thrust runner to slidingly engage the lower thrust bearing base.

13. The assembly according to claim 8, further comprising:

a cylindrical side wall encircling the spring and depending from the upper spring plate;

a shoulder within the coupling that is abutted by a lower end of the cylindrical side wall prior to contact of the rigid stop member with said other of the spring plates; and wherein the amount of downward movement of the upper drive shaft toward the lower drive shaft causes the cylindrical side wall to exert a force against the shoulder and push the coupling downward relative to the second drive shaft.

14. The assembly according to claim 8, wherein:

the upper spring plate has a cylindrical side wall encircling the spring;

the rigid stop member comprises a pedestal extends through an opening in the spring; and a ring circles the cylindrical side wall and is in frictional engagement with an internal wall surface of the coupling.

15. A method of operating a submersible well pump assembly having a pump; a motor; first and second seal sections between the pump and the motor; first and second drive shafts in the first and second seal sections, respectively, each extending along a longitudinal axis; first and second thrust bearings in the first and second seal sections, respectively; and an internally splined coupling that connects ends of the first and second drive shafts together for rotation in unison, the method comprising:

mounting a spring in the coupling between the ends of the first and second drive shafts;

mounting a rigid stop member in the coupling between the ends of the first and second drive shafts;

operating the pump, imposing down thrust from the pump on the first drive shaft and the first thrust bearing and allowing the first drive shaft to undergo movement toward the second drive shaft in response in response to wear of the first thrust bearing;

during the movement of the first drive shaft toward the second drive shaft, compressing the spring and transferring down thrust on the first drive shaft through the spring to the second drive shaft; then with the rigid stop member, stopping the movement of the first shaft toward the second shaft and transferring down thrust on the first drive shaft directly through the rigid stop member to the second drive shaft.

16. The method according to claim 15, wherein while down thrust is passing through the rigid stop member, the down thrust bypasses the spring.

17. The method according to claim 15, wherein the first thrust bearing absorbs more down thrust imposed by the pump than the second thrust bearing until the rigid stop member stops the movement of the first shaft toward the second shaft.

* * * * *